US006663138B1

(12) United States Patent
Zanatta et al.

(10) Patent No.: US 6,663,138 B1
(45) Date of Patent: Dec. 16, 2003

(54) DEVICE FOR COUPLING AN ITEM OF FOOTWARE ON AN ITEM OF SPORTS EQUIPMENT

(76) Inventors: Marco Zanatta, Via Foscarini 8-31040, Nervesa della Battaglia (Treviso) (IT); Luca Zanatta, Via Foscarini 8 -31040, Nervesa della Battaglia (Treviso) (IT)

( * ) Notice: Subject to any disclaimer, the term of this patent is extended or adjusted under 35 U.S.C. 154(b) by 0 days.

(21) Appl. No.: 09/744,708

(22) PCT Filed: Aug. 2, 1999

(86) PCT No.: PCT/EP99/05563

§ 371 (c)(1),
(2), (4) Date: Jan. 29, 2001

(87) PCT Pub. No.: WO00/07476

PCT Pub. Date: Feb. 17, 2000

(30) Foreign Application Priority Data

Aug. 5, 1998 (IT) ..... TV980029 U

(51) Int. Cl.[7] ..... A63C 9/02

(52) U.S. Cl. ..... 280/613; 280/634; 280/14.21; 280/623

(58) Field of Search ..... 280/613–618, 280/634, 636, 14.21, 14.22, 11.3, 11.33, 11.27, 14.24, 623, 625; 74/594.6; 36/117.1, 117.2, 117.3

(56) References Cited

U.S. PATENT DOCUMENTS

| | | | | | |
|---|---|---|---|---|---|
| 3,810,643 | A | * | 5/1974 | Druss | 280/613 |
| 3,902,729 | A | * | 9/1975 | Druss | |
| 4,185,851 | A | * | 1/1980 | Salomon | 280/613 |
| 4,298,210 | A | * | 11/1981 | Lotteau et al. | 280/11.3 |
| 4,728,116 | A | * | 3/1988 | Hill | 280/618 |
| 4,942,778 | A | * | 7/1990 | Bryne | 36/131 |
| 5,474,322 | A | * | 12/1995 | Perkins et al. | 280/613 |
| 5,520,405 | A | * | 5/1996 | Bourke | 280/14.24 |
| 5,662,338 | A | * | 9/1997 | Steinhauser, Jr. | 280/11.27 |
| 5,695,210 | A | * | 12/1997 | Goss et al. | 280/14.23 |
| 5,913,530 | A | * | 6/1999 | Berger et al. | 280/14.21 |
| 6,145,868 | A | * | 11/2000 | Schaller et al. | 280/14.22 |
| 6,270,089 | B1 | * | 8/2001 | Marechal | 280/11.221 |
| 6,299,192 | B1 | * | 10/2001 | Bryce | 280/14.22 |

FOREIGN PATENT DOCUMENTS

| | | | |
|---|---|---|---|
| EP | 0 852 959 | * | 7/1998 |
| FR | 2 045 480 | * | 2/1971 |
| WO | 97/48301 | * | 12/1997 |

* cited by examiner

*Primary Examiner*—Brian L. Johnson
*Assistant Examiner*—Brian L Swenson
(74) *Attorney, Agent, or Firm*—Katten Muchin Zavis Rosenman

(57) ABSTRACT

A device for coupling an item of footwear on an item of sports equipment in order to use the equipment enables the equipment to be detached when not in use. The device comprises a first body (1) fixed to the sole **(1*a*) of the footwear and having a set of shaped protrusions (7) on its visible face, a second body (2) fixed to the sports equipment (2*a*) and having a set of holes (10) the arrangement and number of which are the same as those of the above-mentioned protrusions (7) and into which the protrusions can extend, and an intermediate element (3) rotatable relative to the second body (2) and having a set of holes (14) the arrangement and number of which are the same as those of the protrusions (7) of the first body, the intermediate body being movable between a first position in which the holes (10, 14) are out of alignment with one another and are restrained by resilient means (16), and a second position which can be reached in opposition to the resilient means (16) and in which the holes (10, 14)** have been rendered coaxial with one another.

8 Claims, 3 Drawing Sheets

DEVICE FOR COUPLING AN ITEM OF FOOTWARE ON AN ITEM OF SPORTS EQUIPMENT

FIELD OF THE INVENTION

The present invention relates to a device which permits a footwear to be coupled with a sports equipment in order to perform a sports practice and has such a structure to allow the footwear to be released from the equipment after use.

The present invention relates, more specifically but not exclusively, to a device of the type indicated above for use in particular and advantageously for coupling an item of footwear on a snow-board.

Clearly, however, although specific reference is made to this use by way of example in the present description, the device of the invention may also be used for other sports equipment or products such as, for example, a ski, a roller skate, particularly an in-line roller skate, or a bicycle pedal.

DESCRIPTION OF THE PRIOR ART

A known construction, as disclosed by U.S. Pat. No. 5,474,322, is a binding device comprising a first body fixed to the sole of the footwear and having a set of shaped protrusions on its visible face and a second body fixed to the to a sports equipment, in particular a snowboard, and having a set of holes the arrangement and number of which are the same as those of the protrusions and into which the protrusions can extend. In order to ensure a lock of the protrusions when inserted into the holes a mechanism is foreseen which is of a rather complex construction, not so easy to handle by the user and expensive to produce.

The main object of the present invention is to provide a binding device the structure of which is such as to enable the footwear to be coupled to the sports equipment securely and easily even when extreme forces are exerted on the device during a sports practice, and which can be used for footwear with various types of construction.

Another object of the present invention is to provide a binding device which is of a simple construction and particularly easy to use.

Not the least object is provide a binding device which can be produced at low cost with the use of known machines, tooling and techniques and thus to afford the industrialized production of the various elements.

SUMMARY OF THE INVENTION

These objects are achieved by the provision of a binding device composed of two bodies fixed to the footwear and to the sports equipment (for example a snowboard), respectively, and of an intermediate element interposed between the first two.

The first body is fixed to the sole of the footwear and may be made of metal such as steel or an alloy, or of plastics material, generally nylon, pebax, polyurethane, etc. The body has a base for bearing on the sole; the base may be of any shape, for example, circular, and has one or more protrusions, formed by the body itself, on the opposite side to that which bears against the sole. The body is fixed to the sole by known means of any type such as, for example, a system of one or more screws or rivets, or may be directly incorporated in the sole itself The protrusions may be of any shape but, for simplicity of explanation, reference will be made to a hemispherical shape. Moreover, each protrusion has a rounded end portion and a groove of a given depth is provided on the whole or on a portion of its periphery. A shoulder of the same material as the first body and formed directly thereby may also advantageously be provided on the same side of the first body as the protrusions.

The second body is of the same shape as the first body and, in this embodiment, is circular, is formed of the same material as the first body, and is completely closed to prevent infiltration of snow or the like so as to avoid damage and anomalous operation thereof. One face of the second body is fixed to the sports equipment (for example a snowboard) by the same system as the first body, namely by means of screws or rivets. The second face has one or more holes or slots for housing the corresponding protrusions present on the first body.

The innovative concept upon which the present invention is based, as specified below, consists of the fact that the coupling between the footwear and the sports equipment is achieved simply by the effect of the pressure exerted by the user when he wishes to insert the protuberances or protrusions of the first body of the binding device into the holes of the second body and into the holes of the intermediate element.

In the condition prior to this insertion, the holes of the second body, and hence of the intermediate element, are out of alignment with one another and, by virtue of a particularly flared shape of the holes of the intermediate element, the pressing action performed by the user leads to a rotation of the intermediate element and to an alignment of the holes allowing the protrusions to be inserted fully.

Upon completion of this operation, the resilient means interposed between the second body and the intermediate element re-establish the initial relative positions of the two sets of holes which are thus out of alignment again. In particular, the holes of one set become engaged in respective peripheral recesses or grooves of the protrusions, bringing about locking thereof.

A reverse sequence of steps is performed when the device is to be released, which is easily achieved by temporarily aligning the holes concerned so as to release the protrusions.

BRIEF DESCRIPTION OF THE DRAWINGS

The characteristics and advantages of the device according to the present invention will become clear from the following detailed description of a non-limiting embodiment thereof, given with reference to the appended drawings, in which.

DETAILED DESCRIPTION OF THE INVENTION

Figure 1:
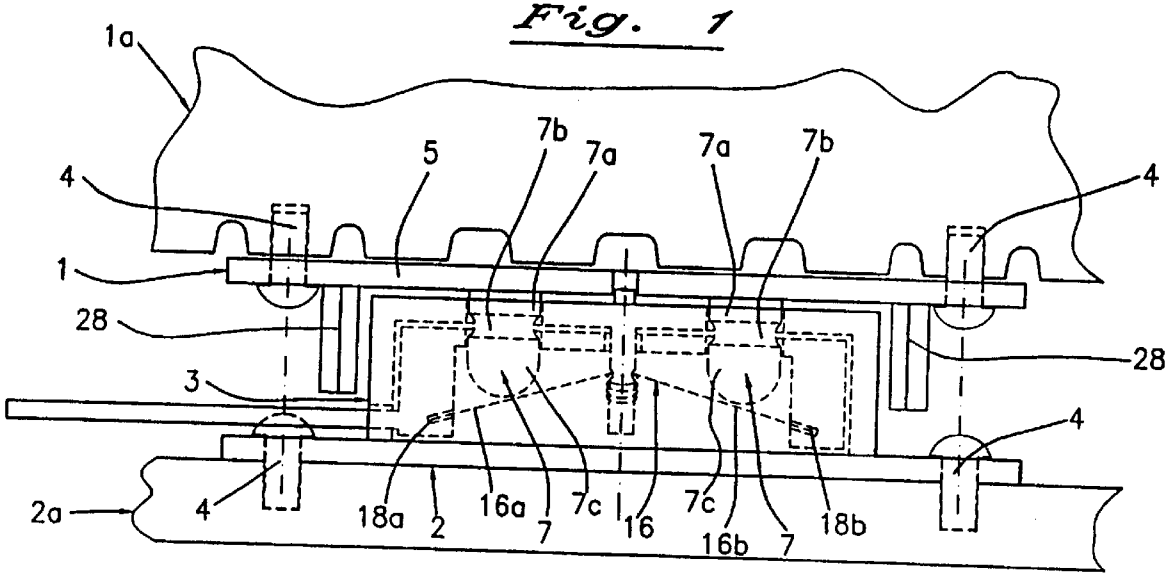
FIG. 1 is a general, schematic side view of the binding device according to the present invention.

With reference to the above-mentioned drawings and, in particular, to FIG. 1, the device of the invention comprises a first body, generally indicated by reference 1, to be fixed to the sole 1*a* of a footwear, particularly a sports shoe, shown schematically in broken outline in FIG. 1.

The device also comprises a second connection body, generally indicated by reference 2, to be fixed to an item of sports equipment 2*a* such as, for example, a snowboard, shown schematically in broken outline in FIG. 1.

Finally, the binding device comprises an intermediate element 3 and referred to herebelow as a counter-disk.

The first body 1 and the second body 2, both of which have a disk-like shape, are fixed to the footwear sole 1*a* and to the sports equipment 2*a*, respectively, in any conventional manner such as, for example, by the provision of fixing rivets 4.

The first body 1 of the binding device according to the present invention will now be described in detail with particular reference also to FIGS. 2 to 4.

As can be appreciated, the first body 1 is constituted by a substantially flattened disk 5 which in the embodiment considered has a substantially circular shape although this shape is not intended to be limiting.

Figure 2:
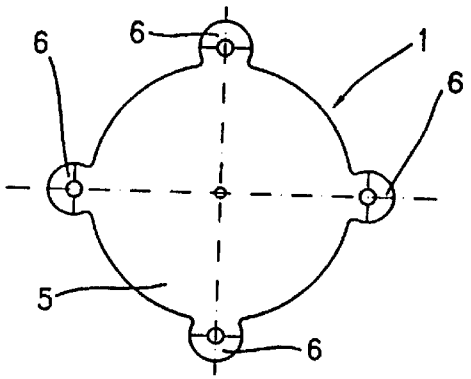
FIG. 2 is a plan view of the first body of the device from the side which bears on and is fixed to the sole of the footwear.
Figure 3:
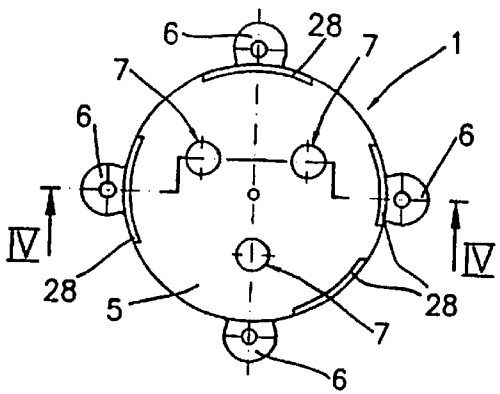
FIG. 3 is a plan view of the above-mentioned first body from the side to be connected to and coupled to the second body of the binding device.

The disk 5 has, on its periphery, a set of radially projecting extensions 6, shown in FIGS. 2 and 3, which are suitably perforated for the fitting of the rivets 4 fixing the first body 1 to the sole 1*a*.

Figure 4:
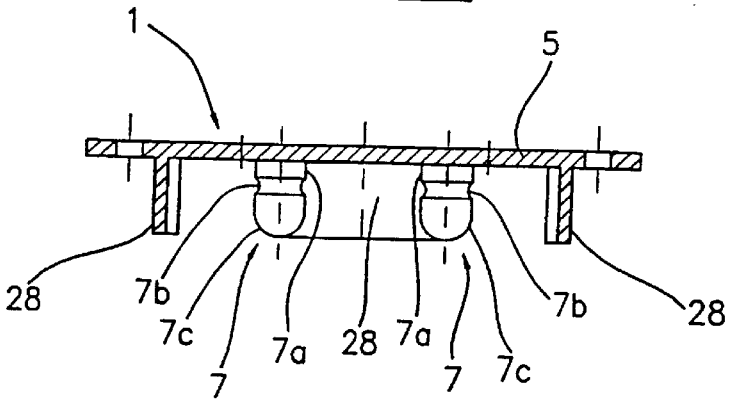
FIG. 4 is a cross-sectional view of the first body taken on the section line IV—IV of FIG. 3.

Moreover, the visible face of the first body 1 (namely the side of the first body 1 opposite to the side which is fixed to the sole 1*a*) has a set of protrusions or protuberances, each indicated 7, which can best be seen in FIGS. 3 and 4. In the embodiment considered, there are three protrusions 7 but, naturally, the number of protrusions 7 may usefully be modified without departing from the scope of the present invention, what is relevant from this point of view being their shape and configuration which will be explained herebelow with reference to FIGS. 1 and 4.

From these drawings, it can be seen that each of the protrusions 7 extends with its longitudinal axis substantially perpendicular to the plane of the disk 5.

Each of the protrusions 7 comprises a first, substantially cylindrical portion 7*a*, close to the said visible face of the body 1 and an end portion 7*c* which is connected to the first portion 7*a* through the peripheral groove 7*b*.

Moreover, the end portion 7*c* of each of the protrusions 7 is substantially hemispherical and this shape (although non-limiting) is intended, together with the peripheral groove 7*b*, to enable the protrusions 7 to be snap-coupled with the second body 2 of the device according to the invention. This operation takes place during the coupling of the first body 1 with the second body 2.

Figure 5:
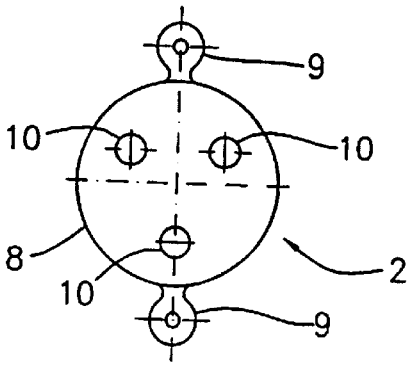
FIG. 5 is a plan view of the second body of the device from the side to be coupled to on the first body of the previous drawings.
Figure 6:
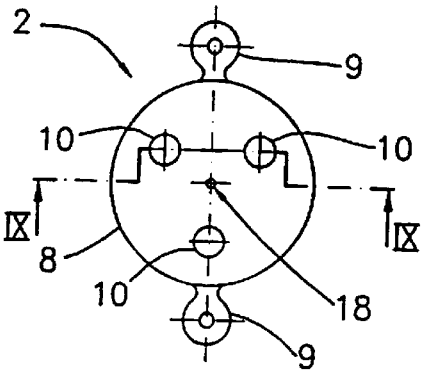
FIG. 6 is a plan view of the above-mentioned second body from the opposite side to FIG. 5.
Figure 7:
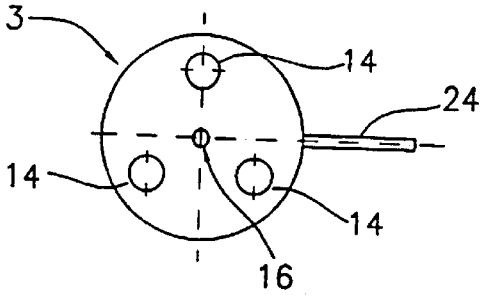
FIG. 7 is a plan view of the intermediate element or counter-disk from the side to which the first body of FIGS. 1 to 4 is coupled.

With reference now to FIGS. 5 and 6, it can be appreciated that the second body 2 is also constituted by a substantially flattened disk 8, also of substantially circular shape in the present embodiment. This shape is of a non-limiting character since the second body 2 is intended to be fixed to the sports equipment 2*a*, that is to a snowboard in the example considered.

Also in this case fixing is achieved by the use of known rivets 4, visible in FIG. 1, fitted in suitably perforated extensions 9 projecting radially from the disk 8, as shown in FIGS. 5 to 9.

According to one of the characteristics of the present invention, the second body 2 has a set of apertures or holes 10, the arrangement and the number of which are the same as those of the protrusions 7 of the first body 1 since they are intended to house these protrusions.

According to a further characteristic of the invention, the diameter of the holes 10 is substantially equal or slightly greater than that of the cross-sections of the protrusions 7, particularly of their cylindrical portions 7*a* and their shaped end portions 7*c*.

With regard to the holes 10, the protrusions 7 can thus be inserted therein and removed therefrom freely, the actual binding of the device being achieved, in particular, owing to the intermediate element or counter-disk 3 described below with particular reference to FIGS. 7 to 10.

The intermediate element 3, which is the sole movable, particularly rotatable, element of the binding device according to the invention, will now be described in detail with particular reference to these drawings. The rotations of the said intermediate element 3 in a first direction permit the coupling of the footwear with the sports equipment (snowboard), whereas its rotations in the opposite direction enable the footwear to be released.

With reference to these drawings, but also bearing in mind FIG. 1, it can be appreciated that the intermediate element 3 is constituted by a flattened disk 12 which has a number of holes or apertures 14 equal to the number of holes 10 of the second body 2 and arranged angularly in the same manner, substantially along the periphery of the disk 12.

The holes 14 are also intended to receive the protrusions 7 of the first body 1 and, more precisely, these holes 14, which can be displaced angularly in a rotary sense relative to the holes 10, on the one hand, allow the protrusions 7 to be inserted and engaged into the holes 10 of the second body 2 but, on the other hand, when rotated in the opposite sense, allow the protrusions to be released therefrom.

Figure 9:
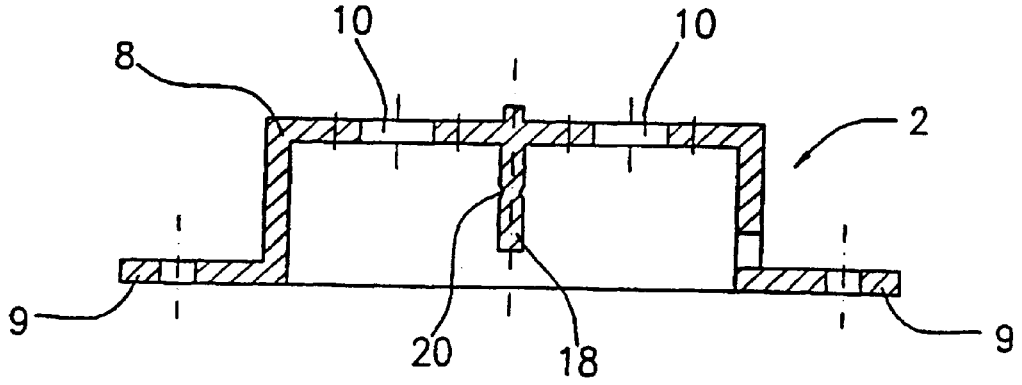
FIG. 9 is a schematic side view showing the first body of the device according to the invention in cross-section.
Figure 10:
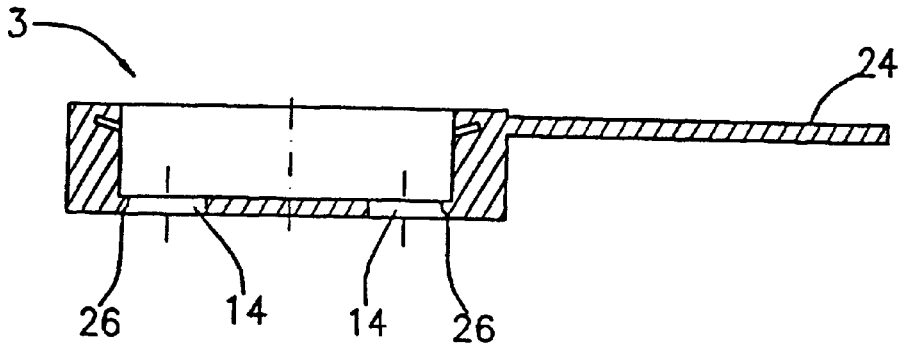
FIG. 10 is a schematic cross-sectional view of the counter-disk of the binding device according to the invention taken on the section line X—X of FIG. 8.

The above-mentioned rotations of the intermediate element 3 are coordinated and assisted by the action of a control and operating spring 16 the central portion of which is wound as a coil on a pin 18 of the second body 2, as can be seen from FIG. 9. The pin 18 projects 8 out of the side of the second body 2 which is in face of the sports equipment 2*a* so as to be perpendicular to the plane of the disk.

It will also be noted that an intermediate region of the pin 18 has a peripheral groove 20 for housing and restraining the coil of the operating spring 16 by any known means.

Figure 8:
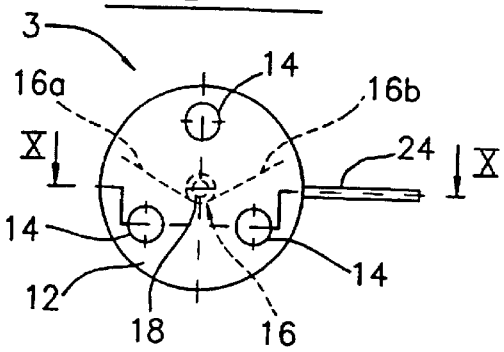
FIG. 8 is a plan view of the above-mentioned intermediate element from the opposite side to the previous drawing.

With reference now to FIGS. 1 and 8, it can be seen that the two arms 16*a* and 16*b* of the spring 16 which extend radially from the pin 18 have their ends inserted into respective suitable seats 18*a* and 18*b* of the intermediate element 3. This element 3 is thus rotatable relative to the second body 2 in opposition to the action of the spring 16 which causes the second body 2 to return to its initial position once the action bringing about its rotation ceases.

As indicated above, rotations of the second body 2 in a first direction enable the protrusions 7 of the first body 1 to be inserted into the holes 10 of the second body 2 and into the holes 14 of the intermediate element 3, respectively, whereas rotations in the opposite direction release the protrusions from the above-mentioned holes.

There are thus two working conditions in the first of which the holes 10 of the first body 2 and 14 of the intermediate element 3 are brought, by the effect of the pressure exerted by the user, so as to be substantially coaxial with one another and this rotation can easily be brought about by the insertion of the protrusions 7 into the above-mentioned holes. The widened and convex shape of the end portions 7*c* of the protrusions 7 permits this insertion whereby the holes 10 and 14, which are initially out of alignment with one another, are brought to a coaxial condition by the insertion of the end portions 7*c* of the protrusions 7, whereas the action of the spring 16 returns the holes to the initial condition in which they are out of alignment and in which the holes 14 of the intermediate element 3 restrain the end portions 7*c* of the protrusions 7 in the second body 2. In this condition, the first body 1 is temporarily locked on or coupled to the second body 2, consequently locking the footwear 1 on the second body 2.

The first body 1 can easily be released from the second body 2 by rotating the intermediate element or counter-disk 3 in the opposite direction to the previous one in order to bring the holes 10, 14 back to a substantially coaxial condition so that the protrusions 7 can be released and removed from the second body 2, thus releasing the footwear 1 from the sports equipment 2*a*.

The above-mentioned operation can easily be brought about by the user by rotating the counter-disk 3. This can be achieved, in the embodiment shown, by means of an operating lever 24 which projects radially from the intermediate element 3 and can be operated in any known manner by the user who can thus easily disengage and release the device whenever he wishes. The rotation will be of a very limited amplitude so that no particular effort is required by the user to bring about the movement from the engaged condition to the released condition.

According to a further advantageous characteristic of the device according to the invention, it has been found that the movement of the device to the coupling condition is brought about by the insertion of the protrusions 7 into the holes 10 and 14 and this is performed by the user by exerting a pressure with the footwear 1 and hence with the protrusions 7, on the second body 2 and on the intermediate element 3. To facilitate the insertion of the protrusions 7 into the said holes, as can be seen in particular from FIG. 10, the upper peripheral edge 26 of each hole 14 of the intermediate element 3 is slightly flared so that the curved, convex profile of the end portions 7*c* of the protrusions 7 can be inserted into the holes 14 with slight forcing. Once this condition bas been reached, the intermediate element 3 is returned to the initial condition by the action of the spring 16, bringing about a temporary coupling and locking of the device.

According to yet another characteristic of the device according to the invention, as can be seen from FIGS. 1, 3 and 4, the first body 1 has on its periphery a set of projecting portions 28 disposed on the same side as the protrusions 7 and constituting a means for guiding and locating the first body 1 relative to the second body 2 in order to position very easily the protrusions 7 in alignment with and into the holes 10 and 14. From this point of view, it is worth appreciating that each of the projecting portions 28 is constituted basically by an arc of a circular ring which extends on the periphery of the first body 1 and is thus intended to come into contact with the periphery of the second body 2. For this purpose, the projections 28 are distributed with their inner walls along a circle having a diameter slightly larger than the outside diameter of the second body 2 so as to permit the above-mentioned location.

In the embodiment illustrated, there are four projecting portions 28 distributed equiangularly on the periphery of the first body 1. However, there could clearly be a different number of projecting portions 28 since their task is that of location for the above-mentioned insertion of the protrusions 7.

The operation of the device according to the invention is extremely simple and can be inferred from the foregoing description. It is, however, worth to notice in detail some particular aspects of the device which render it advantageously easy to use. From this point of view, it suffices to draw attention to the following two operating conditions, which correspond to the coupling of the first body to the second, and to its release, respectively:

1. the temporary locking of the first body 1 on the second body 2 is achieved simply by the effect of pressure imparted by the user to the footwear so that the end portions 7*c* of the protrusions 7 act on the flared portions 26 of the intermediate element 3 to make coaxial the holes 10 of the second body 2 and 14 of the intermediate element 3 respectively, allowing the protrusions 7 to be inserted. This rotation of the intermediate element 3 which, however, is limited, is due to the biasing action of the spring 16;
2. the release operation is performed simply by a rotation of the intermediate element 3 in the opposite direction to the previous one by acting on the operating lever 24; the holes 10 and 14 are thus made coaxial once again, allowing the protrusions 7 to be extracted. The entity of the said rotation is limited by suitable end limiting means (not shown) which are provided, for example, either on the second body 2 or on the sports equipment 2*a*.

Finally, it is clear that structurally equivalent variations and/or modifications may be applied to the device within the scope of the appended claims.

What is claimed is:

1. A device for coupling an item of footwear on an item of sports equipment, and for enabling the equipment to be released when not in use, comprising:

a first body fixed to a sole of the footwear and having a set of shaped protrusions on its visible face, a second body fixed to the sports equipment and having a set of holes, the arrangement and the number of which are the same as those of the protrusions of the first body and into which the protrusions can extend, said second body supporting resilient means having free ends, an intermediate element secured to the free ends of said resilient means and having a set of holes, the number of which are the same as those of the protrusions of the first body, said intermediate element being rotatable relative to the second body by the action of said resilient means between a first position in which the holes of said second body and the holes of said intermediate element are out of alignment with one another, so as to temporarily lock the first body to said second body, and a second position which can be reached in opposition to the action of said resilient means, in which the holes of said second body and the holes of said intermediate element have been rendered coaxial with one another so as to permit the first body to be released from said second body.

2. A device according to claim 1, wherein each protrusion has a first substantially cylindrical portion close to the said visible face of the first body, a substantially convex and rounded end portion and an intermediate peripheral groove.

3. A device according to claim 1, wherein each hole of said intermediate element has, on the side from which the protrusion is inserted, a flared edge constituting a lead-in for the insertion of the protrusion.

4. A device according to claim 1, wherein said intermediate element has a projecting portion for enabling its rotations relative to said second body to be brought about from outside of the device.

5. A device according to claim 1, wherein the first body has, on the side having the protrusions, a set of projecting portions constituting a means for guiding and locating the first body relative to the second body.

6. A device according to claim 5, wherein said projecting portions are disposed along the periphery of the first body.

7. A device according to claim 1, wherein said first body comprises a flattened disk provided with a plurality of radially projecting extensions having perforations for fitting rivets ensuring the fixation of the first body to the sole of the footwear and, wherein said second body comprises a flattened disk provided with a plurality of radially projecting extensions having perforations for fitting rivets ensuring the fixation of the second body to the sports equipment.

8. A device according to claim 7, wherein the resilient means consist of a spring having a central portion wound as a coil on a pin projecting from a side of said second body facing the sports equipment so as to be perpendicular to the plane of the flattened disk of the second body, said spring having free ends inserted into seats of said intermediate element.

* * * * *